US008678261B2

(12) United States Patent
Lee

(10) Patent No.: US 8,678,261 B2
(45) Date of Patent: Mar. 25, 2014

(54) POSITION-LIMITING DEVICE AND MAGAZINE

(75) Inventor: Chung-Yi Lee, New Taipei (TW)

(73) Assignee: Chung-Yi Lee, New Taipei (TW)

( * ) Notice: Subject to any disclaimer, the term of this patent is extended or adjusted under 35 U.S.C. 154(b) by 471 days.

(21) Appl. No.: 13/179,092

(22) Filed: Jul. 8, 2011

(65) Prior Publication Data

US 2013/0008936 A1 Jan. 10, 2013

(51) Int. Cl.
*B25C 1/04* (2006.01)

(52) U.S. Cl.
USPC ..... 227/120; 227/119; 227/130; 227/136

(58) Field of Classification Search
USPC ..... 227/109, 119, 120, 130, 136, 138
See application file for complete search history.

(56) References Cited

U.S. PATENT DOCUMENTS 4,741,467 A * 5/1988 Gassner et al. ..... 227/8
4,821,938 A * 4/1989 Haytayan ..... 227/10
5,975,350 A * 11/1999 Han ..... 221/232
6,672,498 B2 * 1/2004 White et al. ..... 227/120
6,779,697 B2 * 8/2004 Lin ..... 227/120
6,932,261 B2 * 8/2005 Huang ..... 227/120
7,021,511 B2 * 4/2006 Popovich et al. ..... 227/8
7,287,681 B1 * 10/2007 Wen ..... 227/120
7,600,662 B2 * 10/2009 Nayrac et al. ..... 227/120
7,874,469 B2 * 1/2011 Liu ..... 227/142

* cited by examiner

*Primary Examiner* — Scott A. Smith
(74) *Attorney, Agent, or Firm* — Pillsbury Winthrop Shaw Pittman, LLP

(57) ABSTRACT

A position-limiting device forms a portion of a magazine assembly of a powder-actuated fastener-driving gun, and includes a nail-guiding pipe and a clamping unit. The nail-guiding pipe extends through a sleeve of a magazine assembly such that an end of the nail-guiding pipe is disposed outwardly of the sleeve. The nail-guiding pipe includes a tubular body, a nail passage hole formed in the tubular body and in spatial communication with the nail-receiving space in the magazine housing so as to allow one of the nails to be moved from the magazine housing into the nail-guiding pipe therethrough, and two aligned apertures formed respectively in two opposite sides of the tubular body. The clamping unit is disposed on the nail-guiding pipe, and extends through the apertures for clamping the one of the nails disposed within the nail-guiding pipe.

10 Claims, 6 Drawing Sheets

POSITION-LIMITING DEVICE AND MAGAZINE

BACKGROUND OF THE INVENTION

1. Field of the Invention

This invention relates to a position-limiting device, and more particularly to a position-limiting device for a nail magazine assembly.

2. Description of the Related Art

Referring to FIG. 1, a conventional powder-actuated fastener-driving gun has a nail magazine 1 for receiving a row of nails 11. The nails 11 are interconnected fixedly at positioning portions 111 thereof such that, when one of the nails 11 are pushed out of the magazine 1, it can be moved accurately and smoothly to a firing position, and when the one of the mails 11 reaches the firing position, it is parallel to and aligned with the remaining nails 11 along a longitudinal direction of the magazine 1.

However, in a situation where only the last nail 112 is left in the magazine 1, if a magazine housing of the magazine 1 is opened, due to lack of support, the last nail 112 cannot be held at the correct firing position shown by the phantom lines such that it is deviated from a nail-striking direction. After the magazine housing is opened, normally, the user directly closes the magazine housing of the magazine 1, or supplements an additional row of nails 11 into the magazine 1 along the longitudinal direction of the magazine 1 prior to closing of the magazine housing, thereby allowing for subsequent operation of the gun. In either case, the last nail 112 remains in a deviated state. As a result, firing of the gun may result in shooting of the last nail 112 into the magazine housing of the magazine 1 or misfiring of the gun, which leads to sticking of the nails 11 within the magazine 1 or even an accident.

SUMMARY OF THE INVENTION

An object of this invention is to provide a position-limiting device that limits the orientation of a nail to be fired.

Another object of this invention is to provide a magazine assembly for a powder-actuated fastener-driving gun that includes a position-limiting device for limiting the orientation of a nail to be fired.

According to an aspect of this invention, there is provided a position-limiting device adapted for a powder-actuated fastener-driving gun, the powder-actuated fastener-driving gun having a firing portion and a magazine assembly connected to the firing portion, the magazine assembly including a sleeve, a magazine housing connected to the sleeve and defining a nail-receiving space for receiving a row of nails, and a pusher movable within the magazine housing for pushing and moving the nails therewith, the position-limiting device forming a portion of the magazine assembly and comprising:

a nail-guiding pipe adapted to extend through the sleeve such that an end of the nail-guiding pipe is disposed outwardly of the sleeve, the nail-guiding pipe including a tubular body, a nail passage hole formed in the tubular body and adapted to be in spatial communication with the nail-receiving space in the magazine assembly so as to allow one of the nails to be moved from the magazine housing into the nail-guiding pipe therethrough, and two aligned apertures formed respectively in two opposite sides of the tubular body; and a clamping unit disposed on the nail-guiding pipe and extending through the apertures, the clamping unit being adapted for clamping the one of the nails disposed within the nail-guiding pipe.

According to another aspect of this invention, there is provided a magazine assembly for a powder-activated fastener-driving gun, the powder-actuated fastener-driving gun having a firing portion, the magazine assembly comprising:

a sleeve having two opposite ends, one of which is adapted to be connected to the firing portion;

a magazine housing connected to the sleeve and defining a nail-receiving space adapted for receiving a row of nails, and a pusher movable within the magazine housing for pushing and moving the nails therewith; and a position-limiting device including a nail-guiding pipe extending through the sleeve such that an end of the nail-guiding pipe is disposed outwardly of the sleeve, the nail-guiding pipe including a tubular body, a nail passage hole formed in the tubular body and in spatial communication with the nail-receiving space in the magazine housing so as to allow one of the nails to be moved from the magazine housing into the nail-guiding pipe therethrough, and two aligned apertures formed respectively in two opposite sides of the tubular body, and a clamping unit disposed on the nail-guiding pipe and extending through the apertures, the clamping unit being adapted for clamping the one of the nails disposed within the nail-guiding pipe.

As such, the orientation of the one of the nails is limited by the clamping unit to allow the one of the nails to be fired fully.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
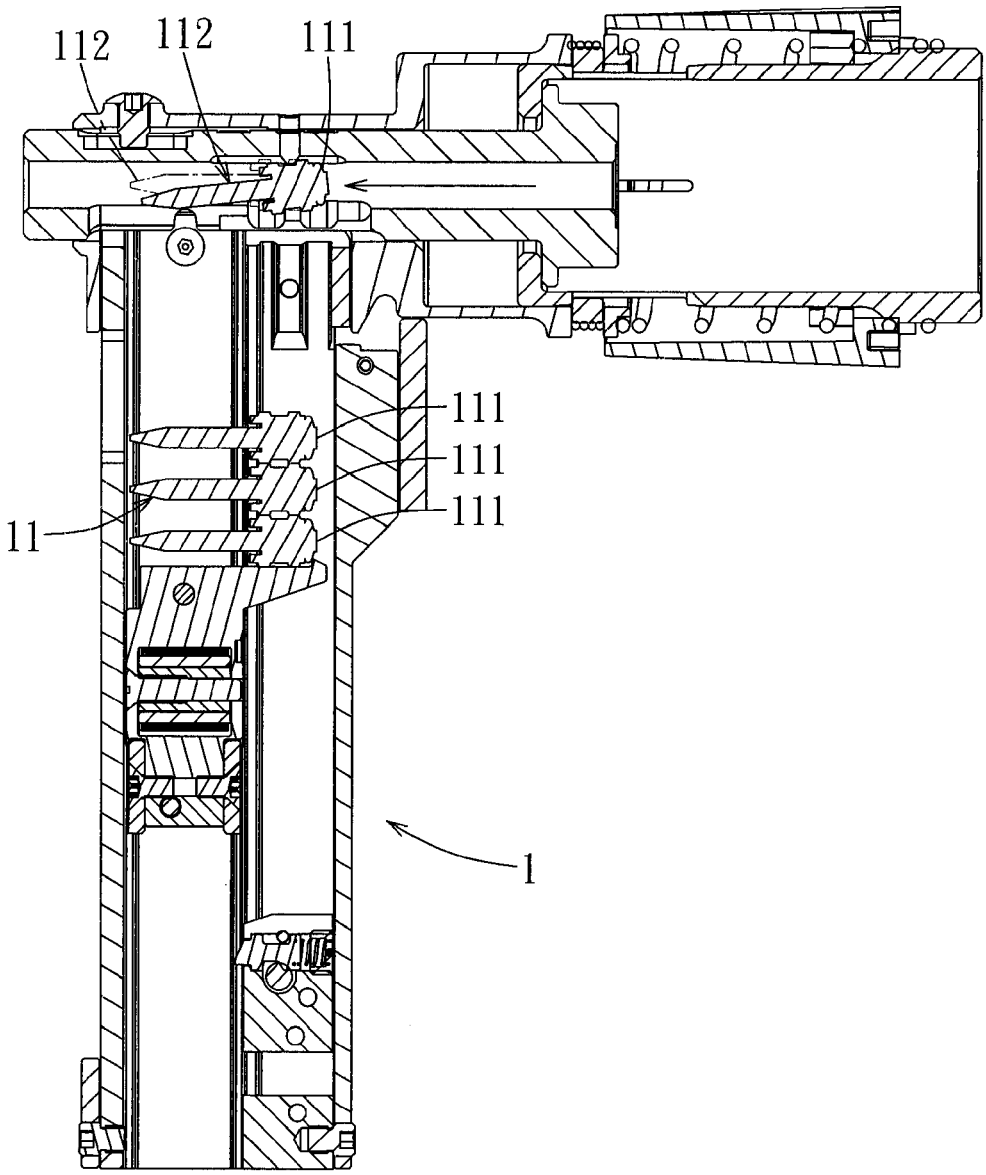
FIG. 1 PRIOR ART
FIG. 1 is a sectional view of a conventional powder-actuated fastener-driving gun, illustrating that a nail is inclined relative to and misaligned from other nails along a longitudinal direction of a nail magazine.
Figure 2:
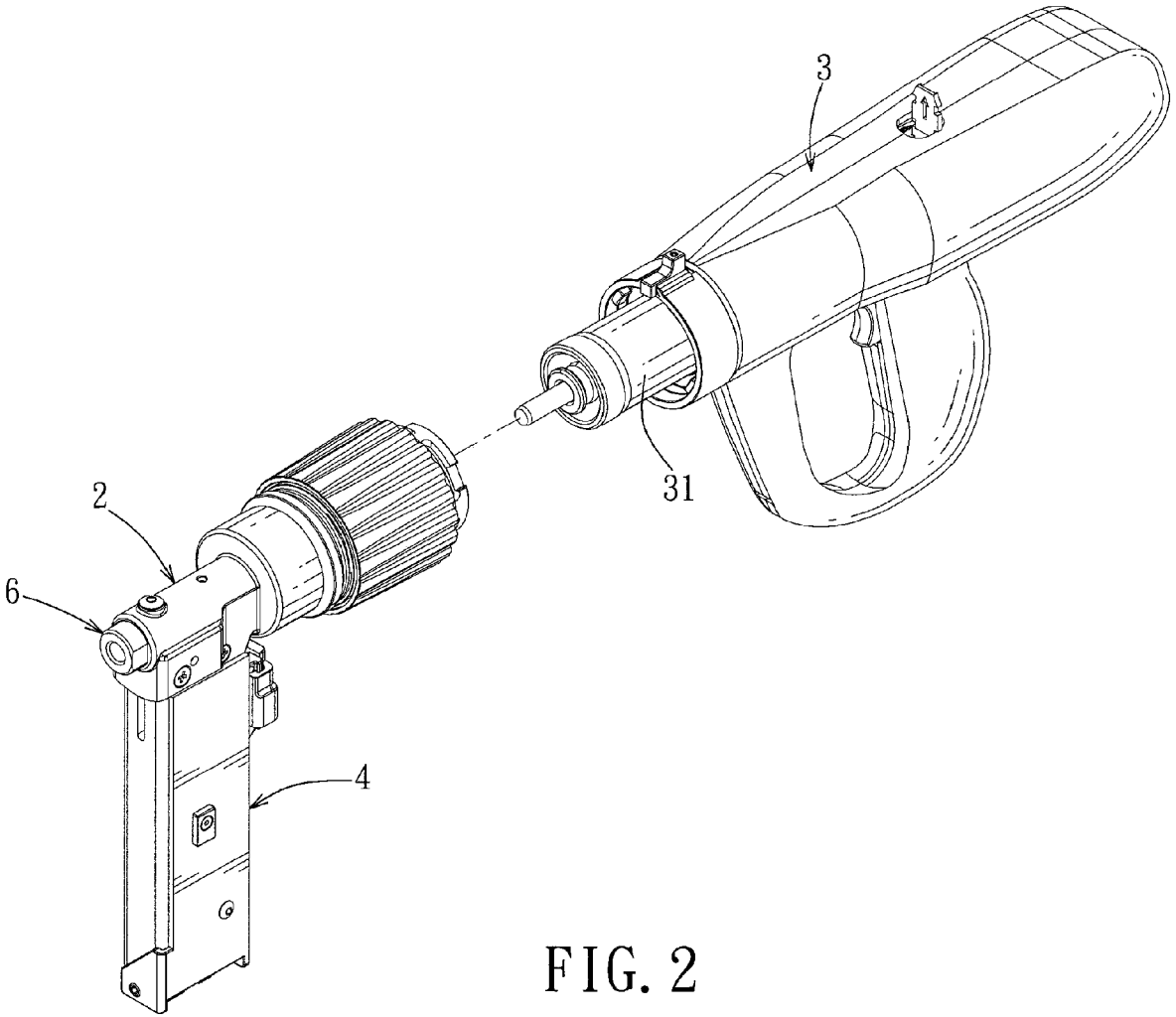
FIG. 2 is a partly exploded perspective view of a powder-actuated fastener-driving gun including the preferred embodiment of a magazine assembly according to this invention.
Figure 3:
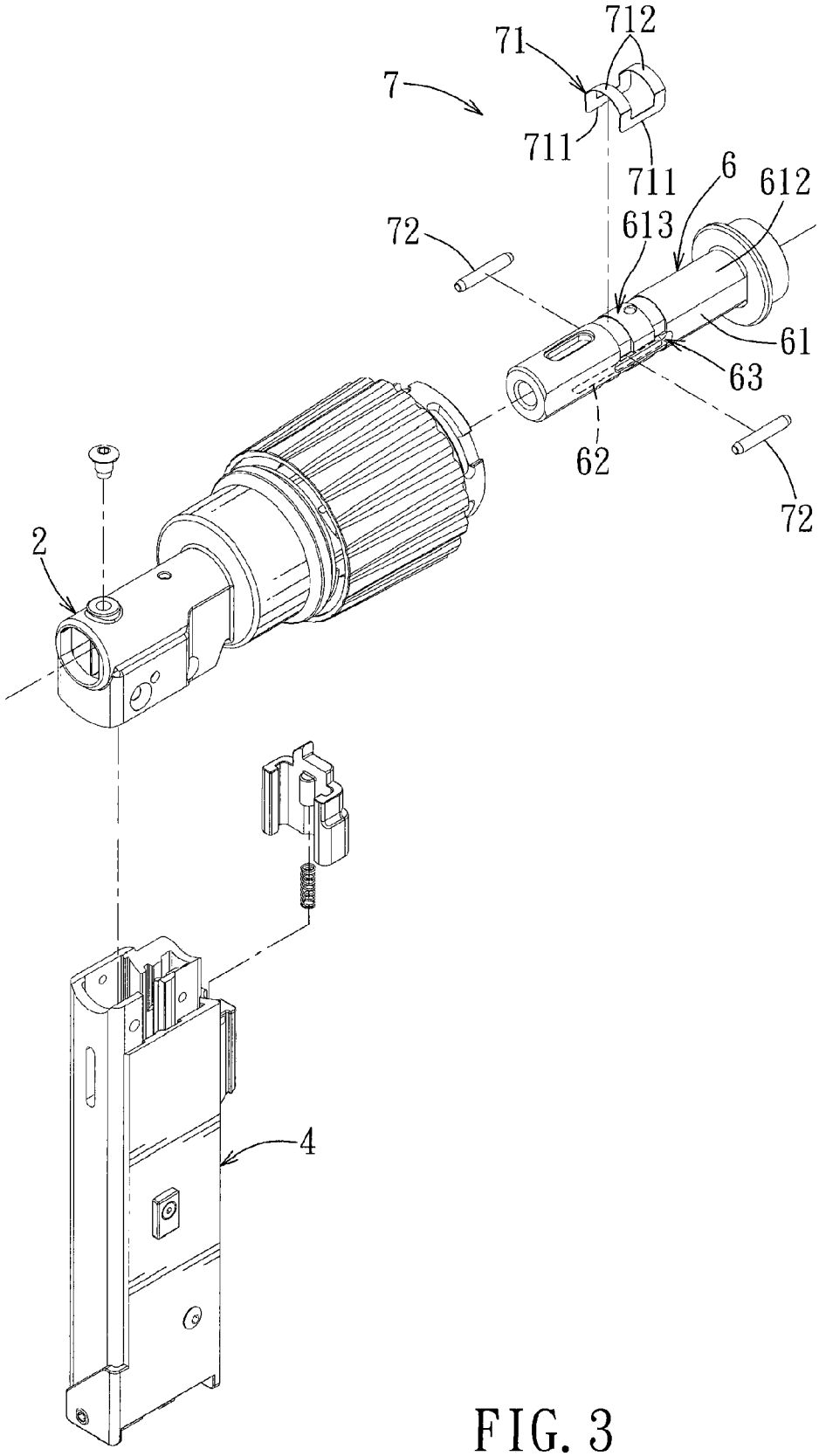
FIG. 3 is a fragmentary exploded perspective view of the powder-actuated fastener-driving gun including the preferred embodiment.
Figure 4:
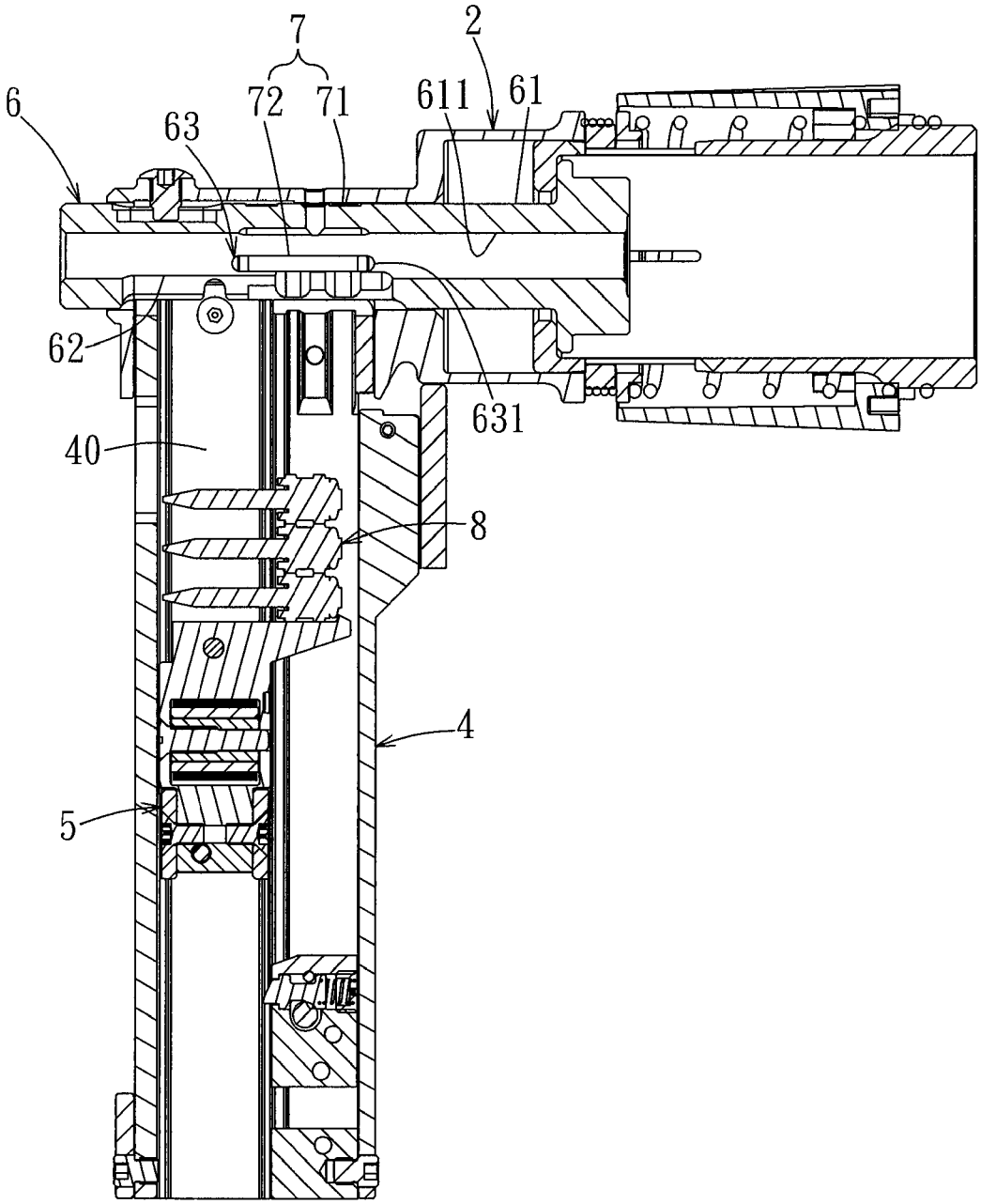
FIGS. 4 and 5 are sectional side views of the preferred embodiment, illustrating how a nail is moved from a magazine housing into a nail-guiding pipe, and how the orientation of the nail is limited by a position-limiting device.

Referring to FIGS. 2, 3, and 4, the preferred embodiment of a magazine assembly according to this invention is used for a powder-actuated fastener-driving gun 3 having a firing portion 31, and includes a sleeve 2, a magazine housing 4, a pusher 5, a nail-guiding pipe 6, and a clamping unit 7.

The sleeve 2 has two opposite ends, one of which is connected fixedly to the firing portion 31 of the powder-actuated fastener-driving gun 3.

The magazine housing 4 is connected to and disposed under the sleeve 2, is perpendicular to a nail-ejecting direction of the powder-actuated fastener-driving gun 3, and permits a row of nails 8 to be received therein. The pusher 5 is disposed in the magazine housing 4 for pushing the nails 8 to move upwardly. In this embodiment, the pusher 5 cooperates with the magazine housing 4 in such a manner that, when the magazine housing 4 is opened, the pusher 5 is moved downwardly to a bottom end portion of the magazine housing 4, so as to define a nail-receiving space 40 for receiving the nails 8; and when the magazine housing 4 is closed, the nails 8 is moved upwardly by the pusher 5 (e.g., from the positions shown in FIG. 4 to the positions shown in FIG. 5) until one of the nails 8 is pushed out of the magazine housing 4 and moved to a firing position.

The nail-guiding pipe 6 extends through the sleeve 2, has an end exposed outwardly of the sleeve 2, and includes a tubular body 61, a nail passage hole 62 formed in the tubular body 61 and in spatial communication with the nail-receiving space 40, two apertures 63 formed respectively in two opposite sides of the tubular body 61, and a recess 613 formed in an outer surface 612 of the tubular body 61 and in spatial communication with the apertures 63.

Figure 6:
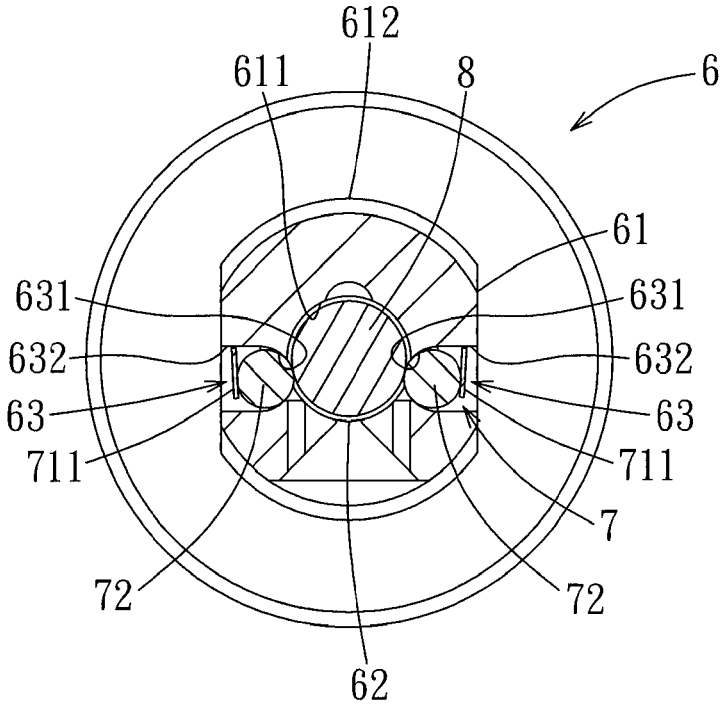
FIG. 6 is a sectional front view of the preferred embodiment, illustrating how the nail is clamped by a clamping unit.

With further reference to FIG. 6, the apertures 63 in the nail-guiding pipe 6 are converged toward each other. Each of the apertures 63 has an inner end 631 formed in an inner surface 611 of the tubular body 61, and an outer end 632 formed in the outer surface 612 of the tubular body 61, opposite to the inner end 631, and having a size slightly larger than that of the inner end 631.

With particular reference to FIG. 3, the clamping unit 7 is received entirely within the recess 613 and the apertures 63 in the nail-guiding pipe 6, and includes a U-shaped biasing member 71 and two generally cylindrical clamping members 72 confined respectively within the apertures 63. Since the sizes of the outer ends 632 are slightly larger than those of the inner ends 631, as described above, portions of the clamping members 72 can project from the inner ends 631, respectively. The biasing member 71 has two resilient arms 711 pressing respectively against the clamping members 72, such that the one of the nails 8 is clamped between the clamping members 72.

Figure 5:
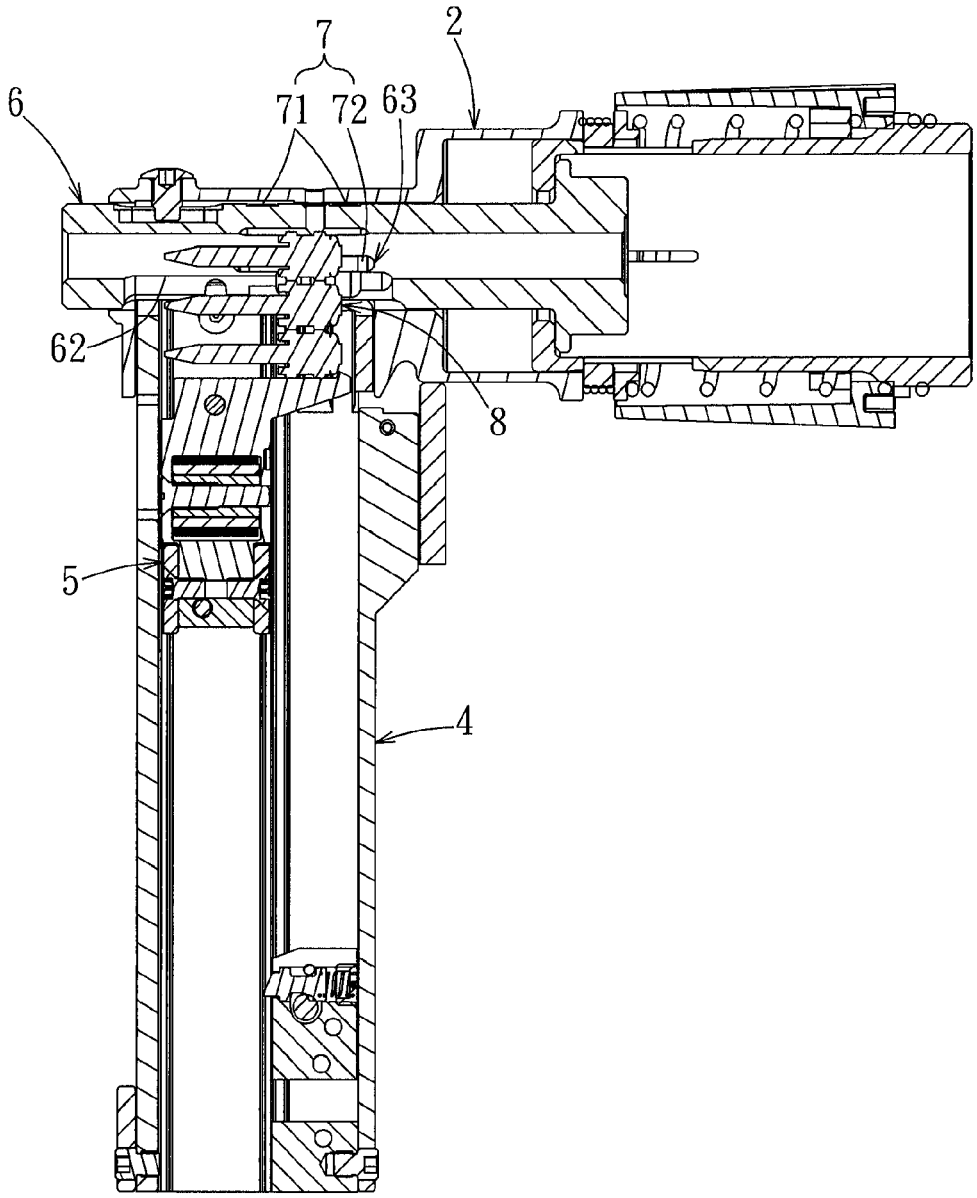

With particular reference to FIG. 5, since the nail passage hole 62 in the nail-guiding pipe 6 is in spatial communication with the nail-receiving space 40 in the magazine housing 4, as described above, the one of the nails 8 can be pushed from the magazine housing 4 into the nail-guiding pipe 6 via the nail passage hole 62. The apertures 63 are positioned such that, when the one of the nails 8 moves to the firing position, it is disposed between the apertures 63. As such, the orientation of the one of the nails 8 is limited by the position-limiting device, so that the one of the nails 8 is maintained automatically at the firing position.

During use, with particular reference to FIGS. 4, 5, and 6, the row of the nails 8 is first placed into the magazine housing 4. Next, the pusher 5 is activated to push the row of nails 8 upwardly until the one of the nails 8 moves to the firing position (i.e., a position between the apertures 63). At this time, the one of the nails 8 is clamped between the clamping members 72 so as to prevent inclination of the one of the nails 8 and movement of the one of the nails 8 along a longitudinal direction of the nail-guiding pipe 6. After each nail-firing operation, the pusher 5 is activated to overcome the clamping force of the clamping members 72 to move the succeeding nail 8 into the nail-guiding pipe 6. The nail-firing operation and the nail-pushing operation are repeated. When the last nail 8 is moved to the firing position, it is also clamped between the clamping unit 7, even if the magazine housing 4 is opened and then closed by the user, thereby ensuring a smooth and accurate last nail-firing operation.

It should be noted that, in this embodiment, each of the clamping members 72 has a portion that is biased to project from the inner end 631 of the corresponding aperture 63 and that has a volume smaller than that of the remaining portion thereof. As such, orientation of the nail 8 clamped between the clamping members 72 can be limited in such a manner to allow for ejection of the nail 8 from the nail-guiding pipe 6. Furthermore, since the biasing member 71 is received entirely within the recess 613 and the apertures 63, an outer surface 712 of the biasing member 71 does not project from the outer surface 612 of the tubular body 61 so that, during assembly, the nail-guiding pipe 6 can be inserted fully into the sleeve 2.

In view of the above, due to cooperation between the nail-guiding pipe 6 and the clamping unit 7, each of the nails 8 can be held at the firing position just before it is ejected from the nail-guiding pipe 6 even in the case of the last nail 8 and even if the magazine housing 4 is opened and then closed anytime by the user. As a consequence, each nail-firing operation is normal. Thus, the objects of this invention are achieved.

With this invention thus explained, it is apparent that numerous modifications and variations can be made without departing from the scope and spirit of this invention. It is therefore intended that this invention be limited only as indicated by the appended claims.

I claim:

1. A position-limiting device adapted for a powder-actuated fastener-driving gun, the powder-actuated fastener-driving gun having a firing portion and a magazine assembly connected to the firing portion, the magazine assembly including a sleeve, a magazine housing connected to the sleeve and defining a nail-receiving space for receiving a row of nails, and a pusher movable within the magazine housing for pushing and moving the nails therewith, said position-limiting device forming a portion of said magazine assembly and comprising:

a nail-guiding pipe adapted to extend through the sleeve such that an end of said nail-guiding pipe is disposed outwardly of the sleeve, said nail-guiding pipe including a tubular body, a nail passage hole formed in said tubular body and adapted to be in spatial communication with the said nail-receiving space in the magazine housing so as to allow one of the nails to be moved from the magazine housing into said nail-guiding pipe therethrough, and two apertures formed respectively in two opposite sides of said tubular body; and a clamping unit disposed on said nail-guiding pipe and extending through said apertures, said clamping unit being adapted for clamping the one of the nails disposed within said nail-guiding pipe.

2. The position-limiting device as claimed in claim 1, wherein said apertures in said nail-guiding pipe are converged toward each other, and each of said apertures has an inner end and an outer end opposite to said inner end and having a size larger than that of said inner end.

3. The position-limiting device as claimed in claim 2, wherein said clamping unit includes two clamping members confined respectively within said apertures in said nail-guiding pipe, each of said clamping members having a portion that is biased to project from a corresponding one of said apertures to press against the one of the nails and that has a volume smaller than that of the remaining portion of a corresponding one of said clamping members.

4. The position-limiting device as claimed in claim 3, wherein said clamping unit further includes a biasing member having two resilient arms pressing respectively against said clamping members, such that the one of the nails is clamped between said clamping members.

5. The position-limiting device as claimed in claim 4, wherein said nail-guiding pipe further includes a recess formed in an outer surface of said tubular body and in spatial communication with said apertures, said biasing member being received entirely within said recess and said apertures.

6. A powder-activated fastener-driving gun, the gun having a firing portion, a magazine assembly comprising:

a sleeve having two opposite ends, one of which is adapted to be connected to the firing portion;

a magazine housing connected to said sleeve and defining a nail-receiving space adapted for receiving a row of nails, and a pusher movable within said magazine housing for pushing and moving the nails therewith; and a position-limiting device including a nail-guiding pipe extending through said sleeve such that an end of said nail-guiding pipe is disposed outwardly of the sleeve, said nail-guiding pipe including a tubular body, a nail passage hole formed in said tubular body and in spatial communication with the said nail-receiving space in the magazine housing so as to allow one of the nails to be moved from the magazine housing into said nail-guiding pipe therethrough, and two apertures formed respectively in two opposite sides of said tubular body, and a clamping unit disposed on said nail-guiding pipe and extending through said apertures, said clamping unit being adapted for clamping the one of the nails disposed within said nail-guiding pipe.

7. The powder-activated fastener-driving gun as claimed in claim 6, wherein said apertures in said nail-guiding pipe are converged toward each other, and each of said apertures has an inner end and an outer end opposite to said inner end and having a size larger than that of said inner end.

8. The powder-activated fastener-driving gun as claimed in claim 7, wherein said clamping unit includes two clamping members confined respectively within said apertures in said nail-guiding pipe, each of said clamping members having a portion that is biased to project from a corresponding one of said apertures to press against the one of the nails and that has a volume smaller than that of the remaining portion of a corresponding one of said clamping members.

9. The powder-activated fastener-driving gun as claimed in claim 8, wherein said clamping unit further includes a biasing member having two resilient arms pressing respectively against said clamping members, such that the one of the nails is clamped between said clamping members.

10. The powder-activated fastener-driving gun as claimed in claim 9, wherein said nail-guiding pipe further includes a recess formed in an outer surface of said tubular body and in spatial communication with said apertures, said biasing member being received entirely within said recess and said apertures.

* * * * *